US011065171B2

(12) United States Patent
Ou et al.

(10) Patent No.: US 11,065,171 B2
(45) Date of Patent: Jul. 20, 2021

(54) ASSISTIVE GLOVE FOR DAILY ACTIVITIES OF STROKE PATIENT

(71) Applicant: SOUTHERN TAIWAN UNIVERSITY OF SCIENCE AND TECHNOLOGY, Tainan (TW)

(72) Inventors: Yang-Kun Ou, Tainan (TW); Ya-Lin Chen, Tainan (TW); Chien-Wei Fu, Tainan (TW); Yi-Hsuan Liu, Tainan (TW); Ying-Ning Tseng, Tainan (TW); You-Shan Li, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 372 days.

(21) Appl. No.: 16/218,776

(22) Filed: Dec. 13, 2018

(65) Prior Publication Data

US 2020/0129362 A1 Apr. 30, 2020

(30) Foreign Application Priority Data

Oct. 26, 2018 (TW) ..... 107138050

(51) Int. Cl.
*A41D 19/00* (2006.01)
*A61H 1/02* (2006.01)

(52) U.S. Cl.
CPC ..... *A61H 1/0288* (2013.01); *A41D 19/00* (2013.01)

(58) Field of Classification Search
CPC ..... A41D 19/00; A61H 1/0288
USPC ..... 2/159
See application file for complete search history.

(56) References Cited

U.S. PATENT DOCUMENTS 8,255,079 B2 * 8/2012 Linn ..... B25J 13/025 700/213
9,067,325 B2 * 6/2015 Ihrke ..... B25J 15/02
10,466,784 B2 * 11/2019 Cohen ..... B25J 13/025
10,888,487 B1 * 1/2021 Rogers ..... A61H 1/00
2006/0189899 A1 * 8/2006 Flaherty ..... A61F 2/50 600/595
2010/0262047 A1 * 10/2010 Genis ..... A61B 5/1126 601/5
2011/0113631 A1 * 5/2011 Zdunek ..... B26B 21/00 30/34.05
2012/0059298 A1 * 3/2012 Hoffman ..... A61F 5/013 602/21
2017/0168565 A1 * 6/2017 Cohen ..... A61B 5/0022
(Continued)

FOREIGN PATENT DOCUMENTS

TW M524640 U 7/2016

*Primary Examiner* — Gloria M Hale
(74) *Attorney, Agent, or Firm* — Rosenberg, Klein & Lee

(57) ABSTRACT

The present invention relates to an assistive glove for daily activities of stroke patient which comprises a main body, a first pulling member, a second pulling member, and plural circular strings. The main body comprises a thumb sleeve, at least one finger sleeve a palm portion connected to the thumb sleeve and the at least one finger sleeve by one side and a wrist portion connected to another side of the palm portion. The first pulling member and the second pulling member are disposed on the palm portion and having a first hook and at least one second hook corresponding to the thumb sleeve and the at least one finger sleeve. The plural circular strings are hung on the first hook and the at least one second hook and fixed to the thumb sleeve and the at least one finger sleeve respectively.

8 Claims, 4 Drawing Sheets

(56) References Cited

U.S. PATENT DOCUMENTS

| | | | | |
|---|---|---|---|---|
| 2019/0209086 | A1* | 7/2019 | Huang | A61B 5/1125 |
| 2020/0129362 | A1* | 4/2020 | Ou | A61H 1/0288 |

* cited by examiner

ASSISTIVE GLOVE FOR DAILY ACTIVITIES OF STROKE PATIENT

BACKGROUND OF THE INVENTION

1. Field of the Invention

The present invention relates to an assistive glove for daily activities of a stroke patient which has pulling members and plural circular strings disposed on the assistive glove to stretch fingers of a stroke patient in a fixed direction for executing daily activities.

2. Description of Related Art

Stroke is a disease caused by obstruction or bleeding of the brain blood vessels and leads to cranial nerve damage, disability of language skills, body movement, vision and intelligent. Since stroke patients usually suffered from uncoordinated movements of the limbs and palm weakness which influence their daily life a lot, different rehabilitation trainings are needed to assist the stroke patients re-learn their daily life skills and train their muscles. Palms of a stroke patient are usually weak and cannot open normally which affect the stroke patient's grip ability and daily life activities. Rehabilitation of hand is much difficult due to its physical structure, so different kinds of rehabilitation tools or devices are needed for hand rehabilitation.

Taiwan utility patent number TW M524640(U), issued on 1 Jul. 2016, discloses a rehabilitation glove. The rehabilitation glove comprises a pair of symmetrical gloves, each of the symmetrical gloves comprises a palm portion and plural finger portions. The palm portion and the plural finger portions are provided with plural magnetic elements which are attracted to each other. A user can put his/her palms together when wearing the rehabilitation glove by the plural magnetic elements in the rehabilitation glove to achieve rehabilitation effects. However, the rehabilitation glove only moves fingers of the user simply; the user still cannot execute normal daily activities when wearing the rehabilitation glove.

SUMMARY OF THE INVENTION

The present invention provides an assistive glove for daily activities of stroke patients comprising a main body, a first pulling member, a second pulling member and plural circular strings.

The main body comprises a thumb sleeve, at least one finger sleeve, a palm portion connected to the thumb sleeve and the at least one finger sleeve by one side, and a wrist portion connected to another side of the palm portion.

The first pulling member has a first hook disposed on the palm portion corresponding to the thumb sleeve.

The second pulling member has at least one second hook disposed on the palm portion corresponding to the at least one finger sleeve.

The plural circular strings are hung on the first hook and the at least one second hook and fixed to the thumb sleeve and the at least one finger sleeve respectively.

According to an embodiment of the present invention, the wrist portion of the main body is further provided with a detachable sensor.

According to an embodiment of the present invention, the at least one finger sleeve is provided with a sensor electrically connected to the detachable sensor.

According to an embodiment of the present invention, the main body has four finger sleeves, the second pulling member has four second hooks corresponding to the four finger sleeves.

According to an embodiment of the present invention, the wrist portion comprises at least one tightness regulating member.

According to an embodiment of the present invention, each of the plural circular strings is a non-elastic circular string.

According to an embodiment of the present invention, the main body is made of a soft material.

Accordingly, the assistive glove for daily activities of a stroke patient of the present invention can make a user stretch his/her fingers passively by the pulling members and the plural circular strings of the present invention. Therefore, the present invention is beneficial for finger rehabilitation and training finger muscles of the user, and can make the user execute motions for daily activities.

DETAILED DESCRIPTION OF THE PREFERRED EMBODIMENT

To provide a thorough understanding, the purpose and advantages of the present invention will be described in detail with reference to the accompanying drawings.

Figure 1:
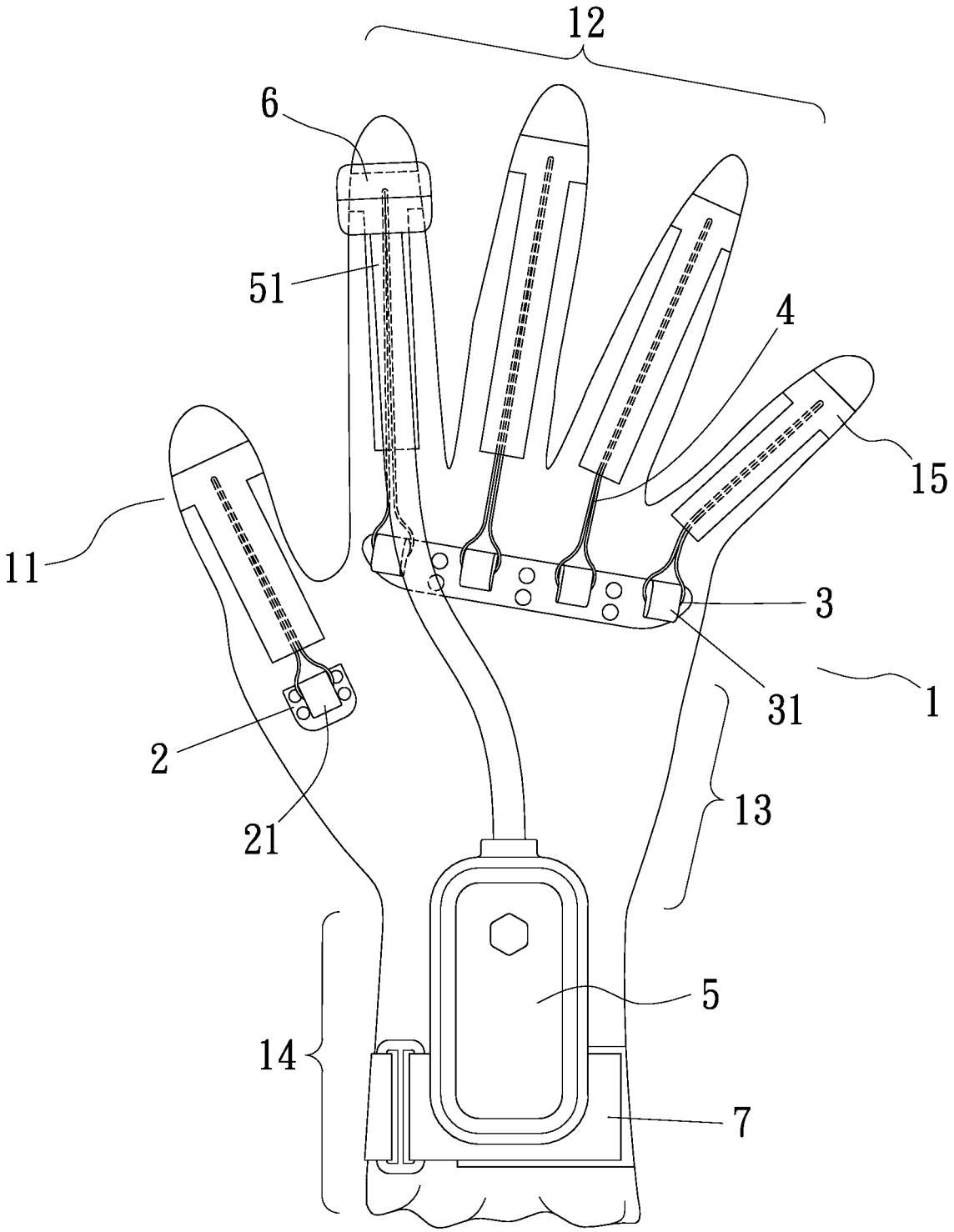
FIG. 1 is a schematic diagram showing an assistive glove for daily activities of a stroke patient of the present invention.
Figure 2:
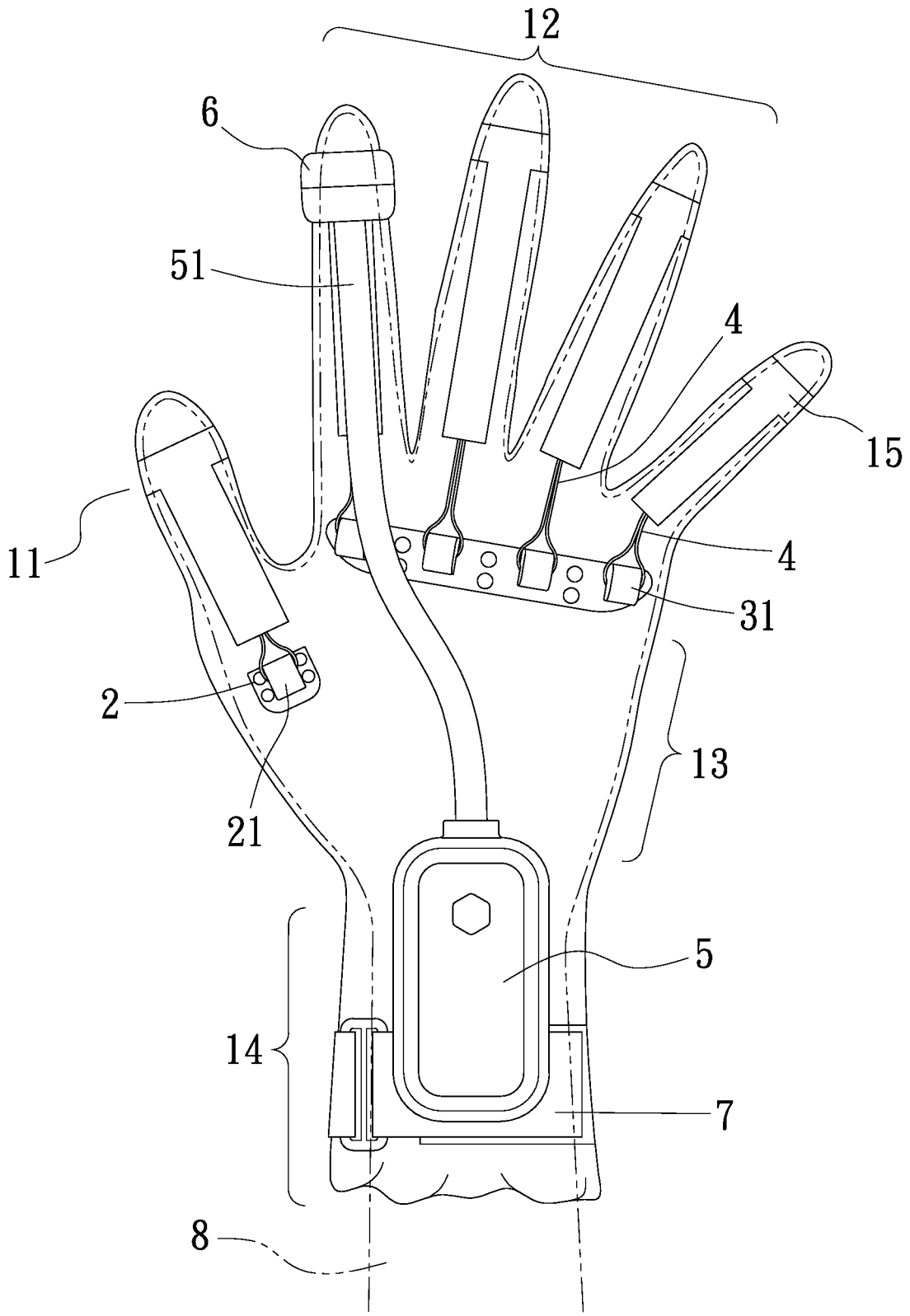
FIG. 2 is a schematic diagram showing an assistive glove for daily activities of a stroke patient of the present invention in a wearing state.

Referring to FIG. 1 and FIG. 2, the assistive glove for daily activities of a stroke patient comprises a main body (1), a first pulling member (2), a second pulling member (3) and plural circular strings (4). The present invention can be a glove for left hand or right hand, and an embodiment below is a glove for left hand which is no intention to limit the invention to the specific forms disclosed.

The main body (1) is made of a soft material such as a fabric material, and comprises a thumb sleeve (11), at least one finger sleeve (12), a palm portion (13) connected to the thumb sleeve (11) and the at least one finger sleeve (12) by one side, and a wrist portion (14) connected to another side of the palm portion (13). The thumb sleeve (11) disposed at one later side of the at least one finger sleeve (12). In FIG. 1 and FIG. 2, the main body (1) comprises four finger sleeves (12).

The first pulling member (2) has a first hook (21) and is disposed on the palm portion (13) corresponding to the thumb sleeve (11). The second pulling member (3) has at least one second hook (31) and is disposed on the palm portion (13) corresponding to the at least one finger sleeve (12). In FIG. 1 and FIG. 2, the main body (1) has four finger sleeves (12), so the second pulling member (3) is provided with four second hooks (31) correspondingly in which each of the four second hooks (31) is disposed at a position corresponding to each of the four finger sleeves (12). The present invention is further provided with plural circular strings (4) hung on the first hook (21) and the at least one second hook (31), and are fixed to the thumb sleeve (11) and the at least one finger sleeve (12) respectively. Length of the plural circular strings (4) affects a bending degree of the thumb sleeve (11) and the at least one finger sleeve (12). Furthermore, each of the thumb sleeve (11) and the at least finger sleeve (12) is provided with a covering members (15) respectively to cover the circular string (4) fixed thereon and prevent loosing of the circular strings (4) from the thumb sleeve (11) and the at least finger sleeve (12).

The wrist portion (14) is further provided with a detachable sensor (5), and a fingertip of the at least one finger sleeve (12) is provided with a sensor (6) which is electrically connected to the detachable sensor (5). The sensor (6) on the fingertip of the finger sleeve (12) is used to monitor an action of a user's finger. In one embodiment, the detachable sensor (5) is electrically connected to the sensor (6) by a transmission wire (51) for receiving the action of the finger from the sensor (6).

The wrist portion (14) comprises at least one tightness regulating member (7) at another side opposite to the palm portion (13) for fixing the main body (1) on the user's wrist comfortably without slipping easily.

Figure 3:
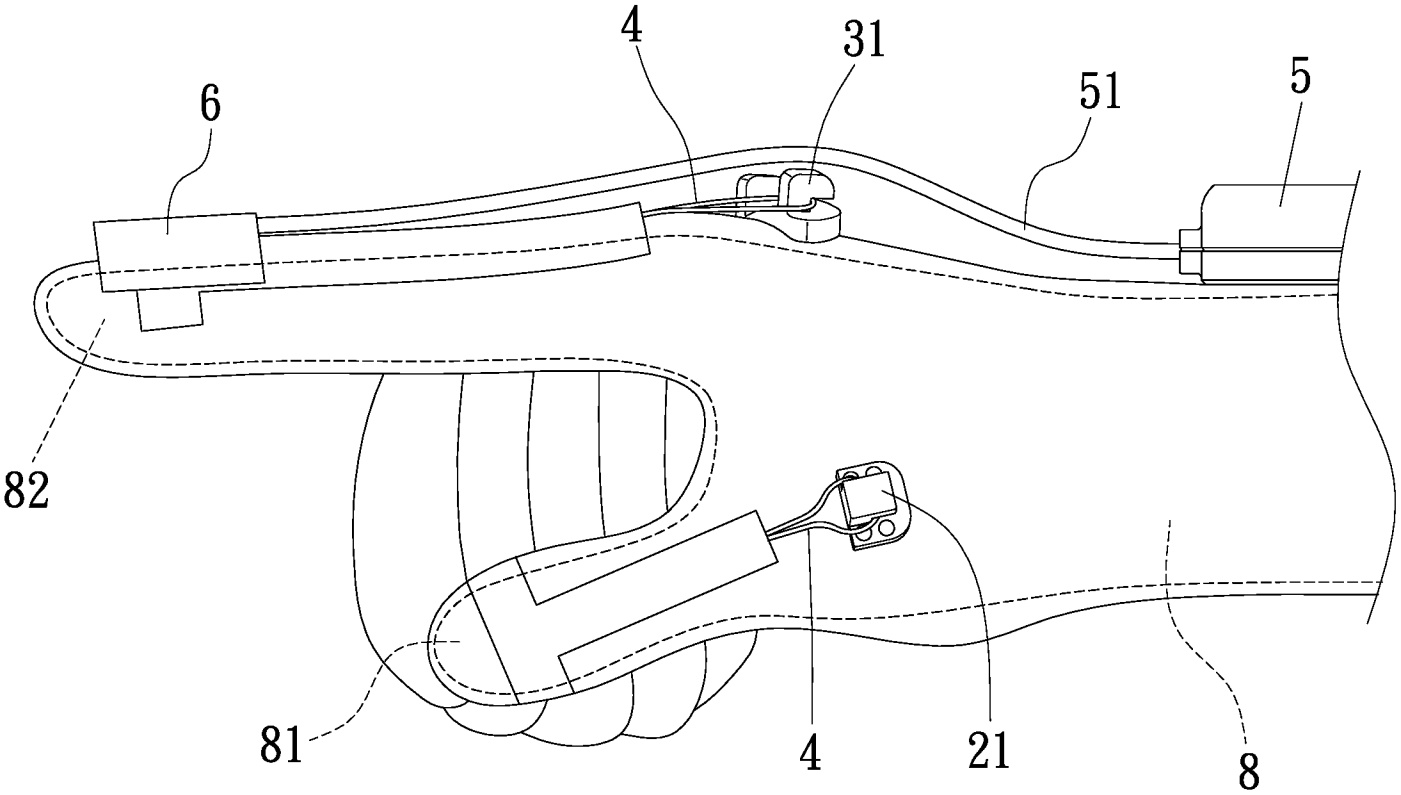
FIG. 3 is a schematic diagram showing an assistive glove for daily activities of a stroke patient of the present invention to stretch a user's fingers.
Figure 4:
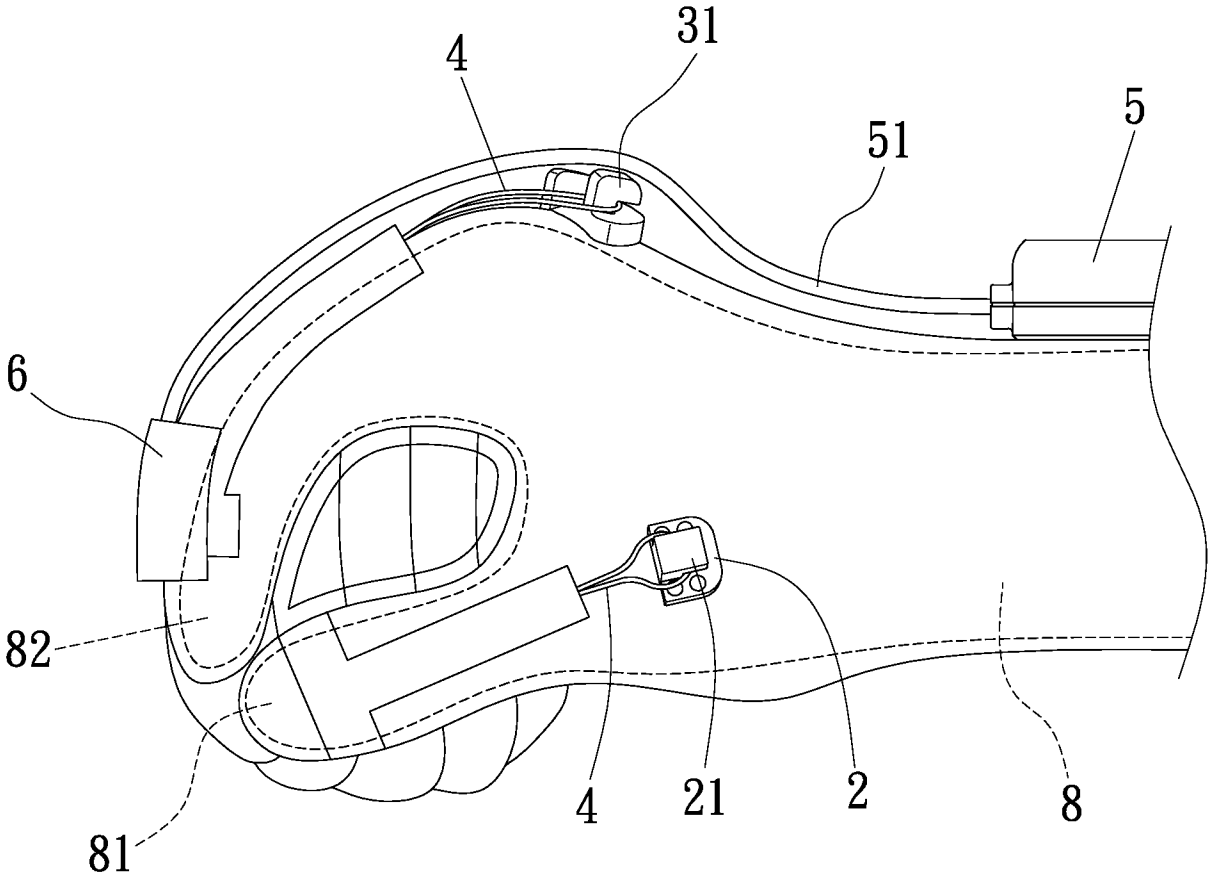
FIG. 4 is a schematic diagram showing an assistive glove for daily activities of a stroke patient of the present invention having a muscle training effect.

Referring FIG. 2, when wearing the present invention, the user's thumb (81) is put into the thumb sleeve (11), and the fingers (82) are put into the finger sleeves (12) respectively, and the hand (8) of the user is covered by the palm portion (13) in which the first pulling member (2) and the second pulling member (3) are located at a back of the hand (8). Referring to FIG. 3, when wearing on the present invention, the thumb (81) and the fingers (82) of the user are stretched to open passively by a pulling force of the circular strings (4). In this embodiment, the thumb sleeve (11) and each of the finger sleeves (12) are pulled by one circular string (4) respectively, so the thumb (81) and the each finger (82) of the user is stretched in a fixed direction to open up the whole palm of the user. Referring to FIG. 4, the user has to exert a force to bend his/her thumb (81) and fingers (82) when wearing the present invention, so the present invention also has finger muscle training effect.

Accordingly to the description above, the assistive glove for daily activities of a stroke patient of the present invention comprises a main body made of a soft material and having a thumb sleeve and at least one finger sleeve, a first pulling member having a first hook and a second pulling member having at least one second hook disposed on the main body corresponding to the thumb sleeve and the at least one finger sleeve respectively, and plural circular strings hung on the hooks and fixed to the thumb sleeve and the at least one finger sleeve. When wearing the present invention, a user can stretch his/her thumb and fingers in a fixed direction due to a pulling force exerted by the plural circular strings so as to prevent hurt of the fingers caused by an improper pulling direction.

What is claimed is:

1. An assistive glove for daily activities of a stroke patient, comprising:

a main body having a thumb sleeve, at least one finger sleeve, a palm portion connected at a distal side thereof to the thumb sleeve and the at least one finger sleeve, and a wrist portion connected to a proximal side of the palm portion;

a first pulling member having a first hook disposed on the palm portion corresponding to the thumb sleeve;

a second pulling member having at least one second hook disposed on the palm portion corresponding to the at least one finger sleeve; and a plurality of circular strings hung on the first hook and the at least one second hook and fixed to the thumb sleeve and the at least one finger sleeve respectively.

2. The assistive glove for daily activities of a stroke patient as claimed in claim 1, wherein the wrist portion of the main body is further provided with a detachable sensor monitoring part.

3. The assistive glove for daily activities of a stroke patient as claimed in claim 2, wherein the at least one finger sleeve is provided with an action sensor electrically connected to the detachable sensor monitoring part.

4. The assistive glove for daily activities of a stroke patient as claimed in claim 1, wherein the main body has four finger sleeves, and the second pulling member has four second hooks corresponding to the four finger sleeves.

5. The assistive glove for daily activities of a stroke patient as claimed in claim 1, wherein the wrist portion comprises at least one tightness regulating member.

6. The assistive glove for daily activities of a stroke patient as claimed in claim 1, wherein each of the plural circular strings is a non-elastic circular string.

7. The assistive glove for daily activities of a stroke patient as claimed in claim 1, wherein the main body is made of a fabric.

8. The assistive glove for daily activities of a stroke patient as claimed in claim 1, wherein a back of each of the thumb sleeve and the at least one finger sleeve is provided with a covering member to cover a respective one of the circular strings.

* * * * *